United States Patent [19]

Kurosawa et al.

[11] Patent Number: 4,695,689

[45] Date of Patent: Sep. 22, 1987

[54] VACUUM CIRCUIT BREAKER

[75] Inventors: Yukio Kurosawa; Kiyoji Iwashita, both of Hitachi, Japan

[73] Assignee: Hitachi, Ltd., Tokyo, Japan

[21] Appl. No.: 799,484

[22] Filed: Nov. 19, 1985

[30] Foreign Application Priority Data

Nov. 22, 1984 [JP] Japan ..... 59-246043

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,522,399 | 7/1970 | Crouch | 300/144 B |
| 3,836,740 | 9/1974 | Hundstad | 200/144 B |
| 4,149,050 | 4/1979 | Gorman et al. | 200/144 B |
| 4,293,748 | 10/1981 | Sakamua et al. | 200/144 B |
| 4,553,003 | 11/1985 | Cherry | 200/144 B |

FOREIGN PATENT DOCUMENTS

| | | | |
|---|---|---|---|
| 1280434 | 2/1961 | France | 200/144 B |

*Primary Examiner*—Mark O. Budd

*Attorney, Agent, or Firm*—Antonelli, Terry & Wands

[57] ABSTRACT

A pair of separable disc shaped electrodes for a vacuum circuit breaker, each including an annular contact part formed around the outer circumferential portion of the electrode on the facing surface to the other electrode, a round recessed part formed on the inner portion thereof and surrounded by the annular contact part, an elastic support plate placed on the non-facing surface thereof and three straight grooves extending from the outer periphery of the annular contact part to the inner periphery thereof so that arcing on the round recessed part is prevented during a circuit breaking operation of the vacuum circuit breaker.

1 Claim, 8 Drawing Figures

VACUUM CIRCUIT BREAKER

FIELD OF THE INVENTION

The present invention relates to a vacuum circuit breaker, and more particularly to an improvement in an electrode structure thereof adapted for magnetically driving arcs between the electrodes by its own interrupting electric current.

BACKGROUND OF THE INVENTION

The vacuum circuit breaker generally comprises a vacuum casing, a pair of separable electrodes disposed in the vacuum casing in that a fixed electrode and a movable electrode facing each other and a pair of electrically conductive rods connected respectively to each electrode at their non-facing surfaces and extending respectively through the vacuum casing to the outside thereof. The other ends of the electrically conductive rods are respectively connected to an electrical source terminal and to a load terminal. Thus a current flows from the source terminal to the load terminal through the one electrically conductive rod, the pair of electrodes and the other electrically conductive rod.

Arcs are generated between the electrodes, when the movable electrode is disconnected from the fixed electrode during the circuit breaking operation.

A current interrupting capacity of a vacuum circuit breaker using simple disc shaped electrodes which form contact is limited, because the arcs between the electrodes stay at a local point of the electrodes and cause local heating of the electrodes, even if the diameter of the electrodes is enlarged.

For increasing the current interrupting capacity of the vacuum circuit breaker, disc shaped electrodes with a plurality of spiral grooves were proposed, wherein arcs are driven along the spiral grooves through an interaction between an arc current and a magnetic field caused by an interrupting current flowing through a current path defined by the spiral grooves so that the local stay of the arc is prevented.

Japanese patent publication No. 22634/1973 and Japanese Preliminary Publication of Pat. Nos. 97061/1973 and 30174/1980 discloses the disc shaped electrodes with a plurality of spiral grooves for vacuum circuit breakers. Since the grooves of these disc shape electrodes are spiral shape, a band saw or a wire cutter was needed to form the grooves on the electrodes which was uneconomical because of a long processing time.

Recently, Japanese Preliminary Publication of Pat. No. 115730/1982 proposed a disc shaped electrode with a plurality of straight grooves for a vacuum circuit breaker which are easily formed by a milling machine.

Figure 6:
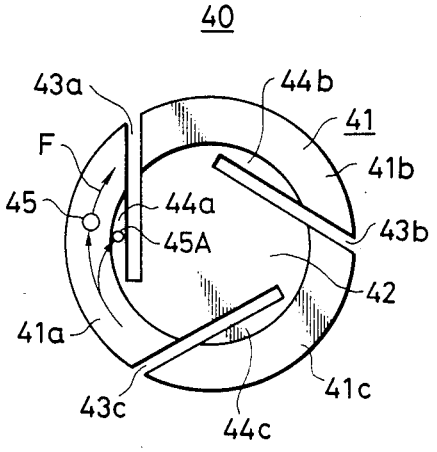
FIG. 6 PRIOR ART
FIG. 6 is a plan view of one of the prior art vacuum circuit breaker electrodes adapted for magnetically driving arcs between the electrodes.
Figure 7:
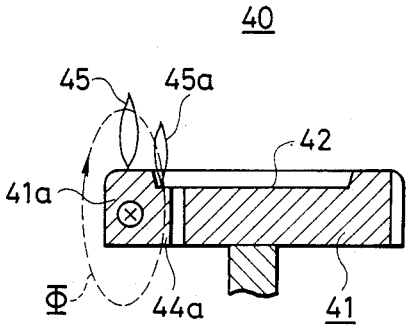
FIG. 7 PRIOR ART
FIG. 7 is a vertical sectional view of FIG. 6.

FIGS. 6 and 7 show the electrode structure of above mentioned Japanese Preliminary Publication of Patent. A disc shaped electrode 40 consists of an annular contact part 41 formed around the outer circumferential portion of the disc shaped electrode and a round recessed part 42 formed on the inner portion thereof and surrounded by the annular contact part 41. Three straight grooves 43*a*, 43*b* and 43*c* which extend from the outer periphery of the annular contact part 41 to the round recessed part 42 are cut on the disc shaped electrode so that three contact pieces 41*a*, 41*b* and 41*c* are formed. Three substantially isolated lands 44*a*, 44*b* and 44*c* are formed between the inner periphery of the annular contact part 41 and the straight grooves 43*a*, 43*b* and 43*c*.

An arc 45, for instance, generated during circuit breaking operation is driven along the circumferential direction or along the straight groove 43*a* shown by an arrow on the contact piece 41*a* by an electromagnetic force F caused by an interaction with a magnetic flux caused by a current flowing along a current path defined by the straight grooves, and some times thereafter an arc 45A is generated on the isolated land 44*a*, because charged particles caused by the arc 45 are apt to be trapped in the space above the isolated land 44*a* due to an axial component of the magnetic flux in the space. Since the direction of the arc 45A is substantially parallel to that of the magnetic flux Φ, the arc 45A is confined within the narrow isolated land 44*a*, and stays there to cause a local melting of the electrode and thus an interruption failure of the vacuum circuit breaker.

SUMMARY OF THE INVENTION

An object of the present invention is to provide a vacuum circuit breaker having improved current interrupting properties.

The vacuum circuit breaker of the present invention comprises a pair of relatively movable disc shaped electrodes, each includes an annular contact part formed around the outer circumferential portion of the disc shaped electrode on the facing surface to the opposing electrode, a round recessed part formed on the inner portion thereof and surrounded by the annular contact part and at least three straight grooves extending from the outer periphery of the annular contact part to the inner periphery thereof so as not to form an isolated land in the round recessed part defined by a straight groove and the inner peripheral wall of the annular contact part thereby preventing an arc from staying on an isolated land in the round recessed part.

DESCRIPTION OF THE PREFERRED EMBODIMENTS

Figure 1:
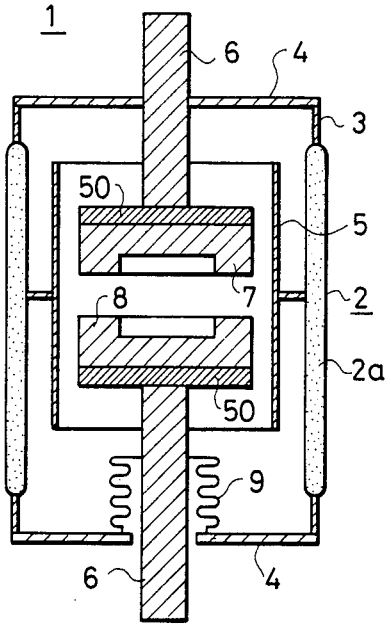
FIG. 1 is a vertical sectional view of one embodiment of the vacuum circuit breaker in accordance with the present invention.

FIG. 1 illustrates one embodiment of the present invention. The vacuum circuit breaker 1 comprises an evacuated vacuum casing 2 formed of an insulating cylinder 2*a*, metal fittings 3 for sealing provided on both ends of the insulating cylinder 2*a*, and a pair of end plates 4 attached to the metal fittings 3; a pair of conductive rods 6 extending through the respective end plates 4 in an air tight manner; a fixed disc shaped electrode 7 connected to one of the conductive rods 6; a movable disc shaped electrode 8 facing to the fixed disc shaped electrode 7 and connected to the other conductive rod 6; bellows 9 provided between the end plate 4 and the other conductive rod 6 to permit axial movement of the movable disc shaped electrode 8 while keeping vacuum in the vacuum casing 2; and a cylindrical metallic vapor shield 5 surrounding the fixed and movable disc shaped electrodes 7 and 8 for preventing metallic vapor diffused from an arc generated between the disc shaped electrodes 7 and 8 from being deposited on the inner surface of the insulating cylinder 2. On the respective non-facing surfaces of the both disc shaped electrodes 7 and 8, elastic support plates 50 of stainless steel are provided so that the both disc shaped electrodes 7 and 8 uniformly contact each other to achieve balanced current flow throughout the contacting surface of both disc shaped electrodes 7 and 8.

Figure 2:
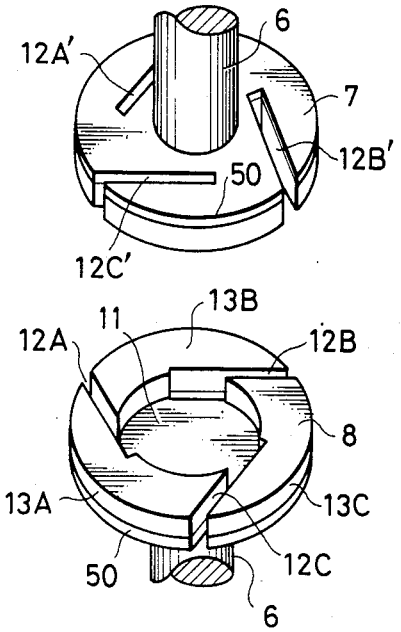
FIG. 2 is a perspective view of the pair of electrodes shown in FIG. 1.
Figure 3:
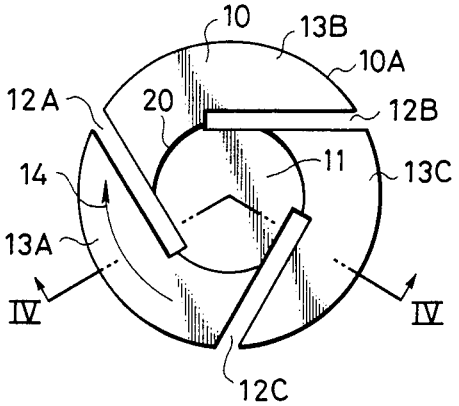
FIG. 3 is a plan view of a electrode shown in FIG. 1.
Figure 4:
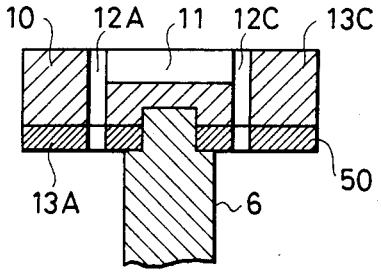
FIG. 4 is a vertical sectional view along line IV—IV of FIG. 3.

Since the structures of the fixed and and movable disc shaped electrodes 7 and 8 are substantially the same, the structure of the movable disc shaped electrode 8 alone is explained referring to FIGS. 2, 3, and 4.

The movable dis shaped electrode 8 includes an annular contact part 10 formed around the outer circumferential portion of the disc shaped electrode 8 on the facing surface to the opposing fixed disc shaped electrode 7, and a round recessed part 11 formed on the inner portion thereof and surrounded by the annular contact part 10. The annular contact part 10 is divided into three contact pieces 13A, 13B, and 13C by three straight grooves 12A, 12B, and 12C which are cut from the outer circumferential periphery 10A of the annular contact part 10 to a boundary line 20 between the inner circumferential periphery of the annular contact part 10 and the inner round recessed part 11. As shown in FIGS. 3 and 4, the straight grooves are not inclined to the axial direction, but extend in parallel to the axial direction and are cut so as to extend substantially tangentially to the boundary line 20 of the inner periphery of the annular contact part 10.

The elastic support plates 50 are also provided with three straight grooves aligned with those formed in the annular contact parts 10 of the respective disc shaped electrodes 7 and 8.

An arc generated between the fixed and movable disc shaped electrodes 7 and 8 is driven around the contact pieces 13A, 13B, and 13C passing through the grooves 12A, 12B, and 12C.

No arcing occurs again at the round recessed portion 11 near the inner periphery of the annular contact part 10, because the portion on the round recessed part 11 where an axial magnetic flux component caused by current flowing through the both electrodes prevails is eliminated and replaced by the three straight grooves 12A, 12B, and 12C.

Figure 5A:
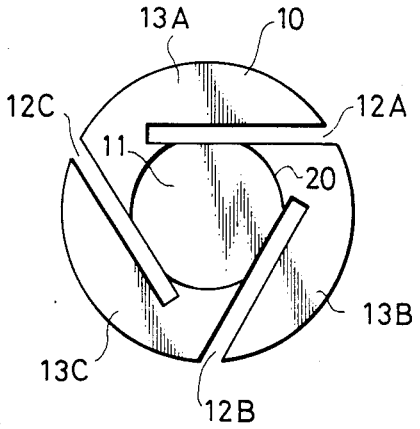
FIGS. 5A and 5B are respectively plan views of other embodiments of the vacuum circuit breaker electrode in accordance with the present invention.
Figure 5B:
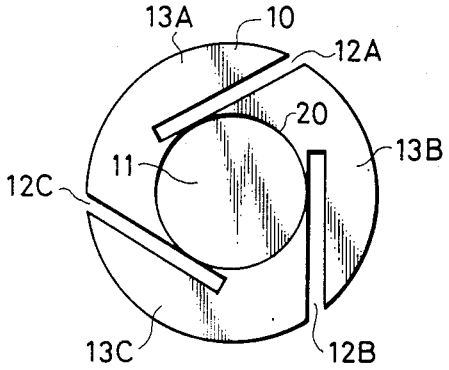

FIGS. 5A and 5B show modified disc shaped electrode structures for the vacuum circuit breaker of the present invention. The three straight grooves 12A, 12B and 12C of FIG. 5A are elongated into the annular contact part 10 through the boundary line 20. The three straight grooves 12A, 12B, and 12C of FIG. 5B are shifted to the outer periphery of the annular contact part 10 to touch the inner walls of the respective grooves 12A, 12B, and 12C with the boundary 20.

With the vacuum circuit breaker of the present invention, the arcing at the round recessed part near the inner periphery of the annular contact part of the disc shaped electrode is prevented, thus interruption failure due to the arc staying at the round recessed part of the disc shaped electrode is eliminated. As a result, the interrupting properties of the vacuum circuit breaker of the present invention is much improved, in that the vacuum circuit breaker with the disc shaped electrodes of 60 mm diameter in accordance with the present invention interrupted 25 kA at 7.2 kV with great ease, on the other hand, the vacuum circuit breaker with the disc shaped electrodes shown in FIGS. 6 and 7 with same diameter interrupted only up to 20 kA at 7.2 kV.

With the vacuum circuit breaker of the present invention, the interruption failure due to the stay of the arcs is eliminated, thus the interrupting properties of the vacuum circuit breaker are much enhanced as explained.

We claim:

1. A vacuum circuit breaker comprising a pair of separable disc shaped electrodes facing to each other and disposed in a vacuum casing, a pair of conductive rods connected to each of said disc shaped electrodes at their non-facing surfaces and extending through the vacuum casing in an air tight manner, each disc shaped electrode including an annular circular part formed around the outer circumferential portion of the disc shaped electrode, a round recessed part formed on the inner portion thereof and surrounded by the annular contact part, and arc preventing means including at least three straight grooves extending from the outer periphery of the annular contact part to the inner periphery thereof for preventing arcing on the round recessed part during a circuit breaking operation of the vacuum circuit breaker, said disc shaped electrode further including an elastic support plate placed on the non-facing surface thereof, the elastic support plate being provided with at least three straight grooves aligned with the straight grooves formed on the respective annular parts.

* * * * *